US008188025B2

(12) United States Patent
Kany et al.

(10) Patent No.: US 8,188,025 B2
(45) Date of Patent: May 29, 2012

(54) SANITIZING AND CLEANING COMPOSITION AND ITS USE FOR SANITIZING AND/OR CLEANING HARD SURFACES

(75) Inventors: Harry Kany, Hettenleidelheim (DE); Holger Theyssen, Freinsheim (DE); Andreas John, Gross-Gerau (DE); Mario Stanga, Bassano (IT); Franco Bruschi, Codogno (IT)

(73) Assignee: Diversey, Inc., Sturtevant, WI (US)

( * ) Notice: Subject to any disclaimer, the term of this patent is extended or adjusted under 35 U.S.C. 154(b) by 0 days.

(21) Appl. No.: 13/082,991

(22) Filed: Apr. 8, 2011

(65) Prior Publication Data

US 2011/0182771 A1 Jul. 28, 2011

Related U.S. Application Data

(63) Continuation of application No. 10/589,384, filed as application No. PCT/US2005/002424 on Jan. 26, 2005, now Pat. No. 7,943,565.

(30) Foreign Application Priority Data

Jan. 28, 2004 (EP) ..... 04001840

(51) Int. Cl.
*C11D 3/48* (2006.01)

(52) U.S. Cl. ..... 510/218; 510/229; 510/234; 510/477

(58) Field of Classification Search ..... 510/218, 510/229, 234, 477
See application file for complete search history.

(56) References Cited

U.S. PATENT DOCUMENTS

| | | | | | |
|---|---|---|---|---|---|
| 4,404,040 | A | | 9/1983 | Wang | |
| 4,715,980 | A | * | 12/1987 | Lopes et al. | 514/574 |
| 4,776,974 | A | * | 10/1988 | Stanton et al. | 514/557 |
| 4,822,513 | A | | 4/1989 | Corby | |
| 4,923,523 | A | | 5/1990 | Schluessler | |
| 5,234,719 | A | | 8/1993 | Richter et al. | |
| 5,330,796 | A | | 7/1994 | Kasari et al. | |
| 5,391,379 | A | | 2/1995 | McKinzie et al. | |
| 5,462,714 | A | | 10/1995 | Talwalker et al. | |
| 5,998,358 | A | * | 12/1999 | Herdt et al. | 510/506 |
| 6,121,219 | A | * | 9/2000 | Herdt et al. | 510/218 |
| 6,221,823 | B1 | * | 4/2001 | Crisanti et al. | 510/238 |
| 6,472,358 | B1 | * | 10/2002 | Richter et al. | 510/234 |
| 6,495,506 | B1 | | 12/2002 | Massaux et al. | |
| 7,745,384 | B2 | * | 6/2010 | Perry et al. | 510/253 |
| 7,943,565 | B2 | * | 5/2011 | Kany et al. | 510/477 |
| 2002/0155969 | A1 | | 10/2002 | Rees et al. | |
| 2003/0185902 | A1 | | 10/2003 | Hei et al. | |
| 2008/0319070 | A1 | * | 12/2008 | Kany et al. | 514/558 |
| 2009/0197786 | A1 | * | 8/2009 | Perry et al. | 510/191 |

FOREIGN PATENT DOCUMENTS

| | | |
|---|---|---|
| DE | 19533994 | 3/1997 |
| EP | 0245928 | 11/1987 |
| GB | 2298431 | 9/1996 |
| JP | 2005511635 | 4/2005 |
| NZ | 260900 | 6/1994 |
| WO | 95/04459 | 2/1995 |
| WO | 99/07222 | 2/1999 |
| WO | 00/61715 | 10/2000 |

OTHER PUBLICATIONS

The International Search Report from the European Patent Office Jun. 6, 2005.
Holleman Wiberg, Lehrbuch der Anorganischen Chemie, 91-100. Auflage (1985), Walter de Gruyter, pp. 600-604.
Rompps Chemie Lexikon, 9. Auflage (1995), Georg-Thieme Verlag (Stuttgart), pp. 1343-1345.
Rompps Chemie Lexikon, 8. Auflage (1985), Francksche Verlagshandlung (Stuttgart), pp. 2623-2624.
CIP: Cleaning in Place, Second Edition (1990), Edited by a J D Romney, pp. 17-40 and 52-55.
Ullmanns Encyklopadie der technischen Chemie, 4. neubearbeitete and erweiterte auflange Band 20, p. 152-156.

* cited by examiner

*Primary Examiner* — Gregory Webb
(74) *Attorney, Agent, or Firm* — Gregory S. Bollis

(57) ABSTRACT

The present invention relates to acidic sanitizing and/or cleaning compositions comprising a specific quaternary antimicrobial system consisting of $C_1$-$C_4$ hydroxyalkyl carboxylic acids, $C_5$-$C_{18}$ alkyl monocarboxylic acids, unsubstituted or substituted, saturated or unsaturated $C_4$-dicarboxylic acids and additional inorganic or organic acids. The compositions of the present invention can be present in the form of concentrates and in the form of diluted use solutions. They can be used in a process for sanitizing and/or cleaning hard surfaces, preferably in a cleaning-in-place (CIP) and/or sanitize-in-place (SIP) process for cleaning and/or sanitizing plants in the food, dairy, beverage, brewery and soft drink industries.

19 Claims, No Drawings

SANITIZING AND CLEANING COMPOSITION AND ITS USE FOR SANITIZING AND/OR CLEANING HARD SURFACES

RELATED APPLICATIONS

This application is a Continuation of U.S. Ser. No. 10/589,384, filed on Jul. 16, 2008, which is a 371 U.S. National Phase of PCT/US2005/002424, filed on Jan. 26, 2005, which claims priority to European Patent Application No. 04001840.0, filed on Jan. 28, 2004.

FIELD OF THE INVENTION

The present invention relates to acidic sanitizing and/or cleaning compositions comprising a specific antimicrobial quaternary system consisting of $C_1$-$C_4$ hydroxyalkyl carboxylic acids, $C_5$-$C_{18}$ alkyl monocarboxylic acids, unsubstituted or substituted, saturated or unsaturated $C_4$ dicarboxylic acids and additional inorganic or organic acids. The compositions of the present invention can be present in the form of concentrates and in the form of diluted use solutions. They can be used in a process for sanitizing and/or cleaning hard surfaces, preferably in a cleaning-in-place (CIP) and/or sanitizing-in-place (SIP) process for cleaning and/or sanitizing plants in the food, dairy, beverage, brewery and soft drink industries.

BACKGROUND OF THE INVENTION

Periodic cleaning and sanitizing in dairy, food and beverage industries, in food preparation and service businesses are a necessary practice for product quality and public health. Residuals left on equipment surfaces or contaminants found in the process or service environment can promote growth of microorganisms. Protecting the consumer against potential health hazards associated with pathogens or toxins and maintaining the quality of the product or service requires routine removing of residuals from surfaces and effective sanitation to reduce microbial populations.

Visual inspection of the equipment cannot ensure that surfaces are clean or free of microorganisms. Antimicrobial treatments as well as cleaning treatments are therefore required for all critical surfaces in order to reduce microbial population to safe levels established by public health regulations. This process is generally referred to as sanitizing. The practice of sanitation is particularly of concern in food process facilities wherein the cleaning treatment is followed by an antimicrobial treatment applied upon all critical surfaces and environmental surfaces to reduce the microbial population to safe levels established by ordinance. A sanitized surface is, as defined by the Environmental Protection Agency (EPA), a consequence of a process or program containing both an initial cleaning and a subsequent sanitizing treatment which must be separated by a potable water rinse. A sanitizing treatment applied to a cleaned food contact surface must result in a reduction in population of at least 99.999% (5 log) for specified microorganisms as defined by the "Germicidal and Detergent Sanitizing Action of Disinfectants", Official Methods of Analysis of the Association of Official Analytical Chemists, paragraph 960.09 and applicable sections, 15th Edition, 1990 (EPA Guideline 91-2).

The antimicrobial efficacy of sanitizing treatments is significantly reduced if the surface is not absolutely free of soil and other contaminants prior to the sanitizing step. The presence of residual food soil and/or mineral deposits inhibit sanitizing treatments by acting as physical barriers which shield microorganisms lying within the organic or inorganic layer from the microbicide. Furthermore, chemical interactions between the microbicide and certain contaminants can disrupt the killing mechanism of the microbicide.

With the advent of automated cleaning-in-place (CIP) and sanitize-in-place (SIP) systems, the need for disassembly has been diminished, and cleaning and sanitizing have become much more effective. However, modern food industries still rely on sanitizers to compensate for design deficiencies or operational limitations in their cleaning programs and the probability of very small residual amounts of organic and inorganic soils and biofilms remaining on food contact surfaces after cleaning. In cooperation with these process changes and higher performance expectations, sanitizer treatments must also comply with the increasing demand for safer, less corrosive, more environmentally friendly compositions.

Therefore, a need exists for improving sanitizing treatments to destroy pathogens and food spoilage microorganisms resistant to conventional treatments within the food gathering, food processing, and food serving industries. Various chemicals exhibiting varying degrees of antimicrobial activity have been used in sanitizing operations. Among these are short-chain monocarboxylic acids having less than 20 carbon atoms, quaternary ammonium compounds and hexachlorophene compounds. These compounds have been admixed with various surfactants and water to yield aqueous sanitizing solutions. Sanitizers containing halogen can be corrosive to metal surfaces of food plants and quaternary ammonium compounds which also have been used, strongly adhere to sanitized surfaces even after copious rinsing and may interfere with desired microbial growth during food processing, e.g. fermentation.

On the other hand, one problem associated with the use of short-chain monocarboxylic acids sanitizers is poor use dilution phase stability, particularly at lower water temperatures of 0 to 10° C. Fatty monocarboxylic acids having alkyl chains containing 5 or more carbon atoms, are typically characterized as water insoluble and can oil out or precipitate from solution as a gelatinous flocculant. Solubility tends to decrease with decreasing water temperature and increasing ionic concentration. Furthermore, the oil or precipitate can affix to the very surfaces which the sanitizing solution is intended to sanitize, such as equipment surfaces, leading to a film formation on these surfaces over time. The fatty acid film deposited and left remaining on the equipment surface tends to have a higher pH than the sanitizing solution from which it came resulting in a significantly lowered biocidal efficacy, and, if mixed with food soil, may result in a film matrix which has the potential of harboring bacteria, an effect opposite to that desired.

Furthermore, antimicrobial solutions containing these antimicrobial agents are undesirable for use in food equipment cleaning applications. Residual amounts of the acidic sanitizing solutions which remain in the equipment after cleaning can impart unpleasant tastes and odors to food. The cleaning compositions are difficult to rinse from the cleaned surfaces. Larger amounts of water are required to completely remove conventional sanitizing solutions.

It has been found that antimicrobial activity of acidic sanitizing solutions as defined above can be increased by acidifying the sanitizer solution to a pH below 5, so that acidic sanitizing solutions of this type are generally used in food, beverage, brewery and other industries as a cleaning-in-place (CIP) and/or sanitize-in-place (SIP) solution for processing equipment. While the acidic sanitizing solutions presently available are effective against gram-negative and gram-positive bacterias such as *Escherichia coli* and *Staphylococcus aureus*, they are not as efficacious on any yeast or mold contamination which can also be present. In many applications control of yeast infections requires a separate solution that can be costly and time consuming.

Such antimicrobiological solutions are generally produced by admixture of water and an aqueous concentrate containing antimicrobiological agents, water or other diluents and acids capable of yielding a pH below about 5 upon dilutions. However, it is clear that such antimicrobial compositions must also exhibit homogeneity and solution stability during prolonged storage periods, in particular at low temperatures. In order to achieve this, solubilizers or coupling agents are added to the compositions in order to maintain stability of the solution at high acid concentrations at prolonged low temperatures or during repeated freeze/thaw cycles.

Such solubilizers are generally surfactant hydrotropes capable of solubilizing the antimicrobial agent in the acidic concentrate which maintain it in both the concentrate and the diluted antimicrobial solution suitable for conventional use. For this purpose various anionic, zwitterionic and nonionic surfactants or mixtures thereof have been previously employed in such solutions: However, these solubilizers, when used in antimicrobial compositions, tend to cause undesirable foaming, thus requiring the addition of foam suppressants for the CIP application and SIP application. Additionally, these solubilizers do not provide stability over a wide range of storage temperatures.

Therefore, there is a need for providing a stable antimicrobial composition which can provide an antimicrobial solution which is equally effective on gram-negative and gram-positive microorganisms and on yeast and on mould, and the antimicrobial activity of which is uneffected by water hardness and which also provides a low foaming antimicrobial use solution capable of removing intense flavour for instance of soft drinks and which is less corrosive and more environmentally friendly.

Now it has been surprisingly found that this need can be satisfied by a specific antimicrobial sanitizing and/or cleaning composition capable of being diluted with a major amount of a food grade diluent to form an antimicrobial use solution.

SUMMARY OF THE INVENTION

Subject-matter of the present invention is according to its first aspect an acidic sanitizing and/or cleaning composition capable of being diluted to form an acidic sanitizing and/or cleaning use solution, the composition comprising:

a) an quaternary antimicrobial system comprising at least one $C_1$-$C_4$ hydroxy alkyl carboxylic acid or salt thereof, at least one $C_5$-$C_{18}$ alkyl monocarboxylic acid having the general formula:

$$R'''—COOH$$

wherein R''' is a straight or branched, saturated or unsaturated alkyl moiety having from about 5 to about 18, preferably from about 6 to about 12 carbon atoms; or salt thereof, at least one dicarboxylic acid having the general formula:

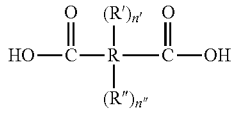

wherein R is a saturated or unsaturated hydrocarbon moiety having 2 carbon atoms; R' is hydrogen, hydroxyl, a substituted or unsubstituted n-alkyl or n-alkenyl moiety having from about 1 to about 12, preferably from about 6 to about 12 carbon atoms, where suitable substituents of R' comprise thiol, methane thiol, amine, methoxy and aryl substituents and n' and n'' each are an integer of from 0 to 4; and R'' represents hydrogen or hydroxyl; or salt or anhydride thereof;

at least one acid capable of yielding a pH of about ≦5.0 upon dilution of the composition to a use solution, b) at least one solubilizer;

c) at least one diluent, preferably water; and d) optionally at least one detergent.

The above acidic sanitizing and/or cleaning composition can be diluted to form an acidic sanitizing and/or cleaning use solution which is equally effective on gram-negative and gram-positive microorganisms and on yeast and on mould, and the antimicrobial activity of which is uneffected by water hardness. The composition of the present invention also provides a low foaming antimicrobial use solution capable of removing intense flavour, e.g. of soft drinks, and being less corrosive and more environmentally friendly than the antimicrobial use solutions of the prior art.

Preferred embodiments of the sanitizing and/or cleaning composition of the present invention are, singly or in any combination, those wherein:

said at least one $C_1$-$C_4$-hydroxy alkyl carboxylic acid (α) is an α-hydroxy carboxylic acid selected from the group consisting of glycolic acid, lactic acid, hydroxy propanoic acid, dihydroxy propanoic acid, hydroxy butyric acid, and mixtures thereof;

said at least one $C_5$-$C_{18}$ alkyl monocarboxylic acid (β) is selected from the group consisting of pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, neodecanoic acid, 2,2-dimethyloctanoic acid and mixtures thereof;

said dicarboxylic acid (γ) is selected from the group consisting of tartaric acid, maleic acid, fumaric acid, succinic acid, n-octyl succinic acid, n-octenyl succinic acid, n-nonyl succinic acid, n-nonenyl succinic acid, n-decyl succinic acid, n-decenyl succinic acid, n-hexyl succinic acid, n-hexenyl succinic acid, diisobutenyl succinic acid, methyl heptenyl succinic acid and mixtures thereof; preferably is n-octenyl and/or n-nonenyl succinic acid(s);

said acid (δ) is an organic acid, preferably an organic acid selected from the group consisting of formic acid, acetic acid, citric acid, and alkyl sulfonic acid, preferably methyl sulfonic acid and mixtures thereof; or an inorganic acid, preferably an inorganic acid selected from the group consisting of phosphoric acid, sulfuric acid, nitric acid (preferably in combination with a small amount (preferably about 1 wt. %) of urea to prevent $NO_x$ formation), hydrochloric acid, sulfamic acid and mixtures thereof, more preferably, said acid (δ) is selected from the group consisting of phosphoric acid, nitric acid, sulfuric acid, methyl sulfonic acid and mixtures thereof;

the mono- and dicarboxylic acids (β, γ) are present in a weight ratio of between about 1:1 and about 1:20, preferably between about 1:2 and about 1:10;

said at least one solubilizer (b) is a surfactant-hydrotrope selected from the group consisting of anionic surfactants, nonionic surfactants, zwitterionic surfactants and mixtures thereof;

the anionic surfactant is selected from the group consisting of alkyl sulfonates and alkylaryl sulfonates having about 8 to about 22, preferably about 8 to about 18 carbon atoms in the alkyl portion, ammonium, alkali metal or alkaline earth metal salts or mixtures thereof, preferably it is sodium or potassium alkyl benzene sulfonate, sodium or potassium xylene sulfonate, sodium or potassium cumene sulfonate or sodium or potassium toluene sulfonate;

the zwitterionic surfactant is selected from the group consisting of alkylimidazolines, alkylamines and mixtures thereof;

the nonionic surfactant is selected from the group consisting of ethylene oxide adducts of $C_8$ to $C_{22}$, preferably $C_8$ to $C_{16}$, more preferably $C_8$ to $C_{12}$ alcohols, ethylene oxide/propylene oxide adducts of ethylene glycol, alkylene glycols or mixtures thereof;

said at least one diluent is selected from any food grade diluent, preferably water and short chain alcohols having 2 to 5 carbon atoms, most preferably is potable water;

said $C_1$-$C_4$-hydroxyalkyl carboxylic acid (α) is present in an amount of from about 0.25 to 15, preferably from about 1 to 10, more preferably from about 2 to 8, most preferably from about 3 to 5 wt. %, based on the total amount of the composition;

said $C_5$-$C_{18}$ alkyl monocarboxylic acid (β) is present in an amount of from about 0.1 to 5, preferably from about 0.3 to 4, most preferably from about 0.5 to 2.0 wt. %, based on the total amount of the composition;

said dicarboxylic acid (γ) is present in an amount of from about 0.1 to 8, preferably from about 0.5 to 6, most preferably from about 1 to 4.5 wt. %, based on the total amount of the composition;

said acid (δ) is present in an amount of from about 4.0 to about 60.0, preferably from about 10 to 40 wt. %, based on the total amount of the composition;

said diluent (c) is present in an amount of from about 10 to about 95.5, preferably from about 15 to 90 wt. %, based on the total amount of the composition;

said detergent (d) is present in an amount of from about 5 to 30, preferably from about 10 to 25 wt. %, based on the total weight of the concentrate;

said composition is diluted with water in a ratio of from about 1:10 to about 1:500, preferably from about 1:30 to about 1:400 and more preferably from about 1:50 to about 1:100 parts of composition to diluent (c).

Subject-matter of the present invention is, according to a second aspect, also a low foaming acidic sanitizing and/or cleaning use solution comprising:

a) a quaternary antimicrobial system comprising:

at least one $C_1$-$C_4$ hydroxy alkyl carboxylic acid or salt thereof, at least one $C_5$-$C_{18}$ alkyl monocarboxylic acid having the general formula:

$$R'''—COOH$$

wherein R''' is a straight or branched, saturated or unsaturated alkyl moiety having from about 5 to about 18, preferably from about 6 to about 12 carbon atoms; or salt thereof, at least one dicarboxylic acid having the general formula:

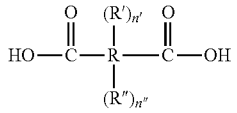

wherein R is a saturated or unsaturated hydrocarbon moiety having 2 carbon atoms; R' is hydrogen, hydroxyl, a substituted or unsubstituted n-alkyl or n-alkenyl moiety having from about 1 to about 12, preferably from about 6 to about 12 carbon atoms, where suitable substituents of R' comprise thiol, methane thiol, amine, methoxy and aryl substituents and n' and n'' each are an integer of from 0 to 4; and R'' represents hydrogen or hydroxyl; or salt or anhydride thereof;

at least one acid capable of yielding a pH of about ≦5.0 upon dilution of the composition to the use solution, b) at least one solubilizer;

c) at least one diluent, preferably water; and d) optionally at least one detergent.

The sanitizing and/or cleaning use solution as defined above can be prepared by diluting the sanitizing and/or cleaning composition according to the present invention with a food grade diluent, preferably potable water, in a ratio of from about 1:10 to about 1:500, preferably from about 1:30 to about 1:400 and more preferably from about 1:50 to about 1:100 parts of composition to diluent.

A preferred embodiment of the use solution of the present invention is a low foaming, acidic antimicrobial sanitizing and/or cleaning use solution prepared by diluting the composition as defined above with potable water in such ratio, that it comprises:

a) between about 1 about 5000 ppm, preferably from about 5 to about 3000, most preferably from about 10 to about 1500 ppm of the antimicrobial system (α-γ);

b) from about 5 to about 10 000, preferably from about 10 to about 5000 ppm of the solubilizer (b) and c) a sufficient amount of the acid (δ) to yield a pH below about 5.0, preferably from 4.5 to 1.0, d) optionally a sufficient amount of the detergent (d) to induce surface wetting and soil removal and e) water as the balance of the composition.

A further subject-matter of the present invention is according to a third aspect a process for sanitizing and/or cleaning a hard surface, preferably a cleaning-in-place (CIP) and/or sanitize-in-place (SIP) process for cleaning and/or sanitizing plants in the food, dairy, beverage, brewery and soft drink industries, the process being carried out by contacting a low foaming acidic, aqueous, antimicrobial use solution as defined above at a temperature of from 0 to 80° C., preferably from 5 to 60° C., with the hard surface to be cleaned and/or santized for about 30 s to about 20 min, preferably for about 1 to about 5 min, draining off the use solution with or without recycling it and finally rinsing the hard surface with potable water.

Further details of the present invention are as follows where it is to be considered that the type and the amount of the stated components of the composition and of the use solution of the present invention may be varied in such manner that antimicrobial sanitizing and/or cleaning compositions are obtained which have the desired characteristics and lead to the desired effects.

The quaternary antimicrobial system being one of the essential components of the sanitizing and/or cleaning composition of the present invention comprises:

a $C_1$-$C_4$ hydroxyalkyl carboxylic acid, preferably an $\alpha$-$C_1$ to $C_4$ hydroxyalkyl carboxylic acid. Examples of suitable hydroxyalkyl carboxylic acids include, but are not limited to, hydroxy propanoic acid, dihydroxy propanoic acid, hydroxy citric acid, hydroxy butyric acid, tartaric acid, glycolic acid, lactic acid and mixtures thereof;

a $C_5$ to $C_{18}$ alkyl mono carboxylic acid, preferably a $C_5$ to $C_{12}$ alkyl mono carboxylic acid. Its alkyl residue may be straight or branched, saturated or unsaturated;

the dicarboxylic acids usable in the present invention are those having a saturated or unsaturated $C_1$-$C_4$-carbon back bone. Specifically, the substituted dicarboxylic acids employed herein are selected from the group consisting of maleic acid and fumaric acid and, preferably, succinic acid. The particularly preferred succinic acids employed in the present invention are selected from the group consisting of n-octyl succinic acid, n-octenyl succinic acid, n-nonyl succinic acid, n-nonenyl succinic acid, n-decyl succinic acid, n-decenyl succinic acid, n-hexyl succinic acid, n-hexenyl succinc acid, diisobutenyl succinic acid, methyl heptenyl succinic acid and mixtures thereof. Most preferably n-octenyl succinic acid and/or n-nonyl succinic acid(s) is (are) employed;

the antimicrobial system of the present invention also contains an acid capable of providing a solution pH at or below about 5.0 when the composition is diluted to its use solution strength. The used acid must be compatible with the other components of the sanitizing solution, i.e. must not induce instability or cause undue degradation of a surfactant or organic acids. This acid may be either a weak organic acid such as formic acid, acetic acid, citric acid, tartaric acid, maleic acid, fumaric acid or mixtures thereof or a stronger organic acid such as alkylsulfonic acid, preferably methylsulfonic acid or an inorganic acid such as phosphoric acid, sulfuric acid, nitric acid (preferably in combination with a small amount (about 1 wt. %) of urea to prevent $NO_x$ formation), hydrochloric acid, sulfamic acid or mixtures thereof. Preferably, phosphoric acid, nitric acid, sulfuric acid, and methylsulfonic acid are used.

The solubilizer used in the present invention is a surfactant hydrotrope capable of solubilizing the alkyl monocarboxylic acid and the dicarboxylic acid in an acidic diluent while maintaining the monocarboxylic acid and the dicarboxylic acid in solubilized form in both the composition and the diluted use solution of the product under use conditions. Various anionic, zwitterionic and nonionic surfactants or mixtures thereof can be used in the present invention.

Examples of the anionic surfactants which may be used in the present invention are alkyl sulfonates and alkylaryl sulfonates having from about 8 to about 22 carbon atoms in the alkyl portion, as well as the alkali metal salts thereof. Commercially important are the sodium and potassium salts of linear alkyl sulfonates such as sodium lauryl sulfonate and the potassium alkylbenzene sulfonates such as sodium xylenesulfonate, sodium cumenesulfonate, sodium toluenesulfonate.

Suitable zwitterionic surfactants are the alkyl imidazolines and alkylamines marketed under the trademark MIRAPON by Miranol.

Examples of the nonionic surfactants which may be used in the compositions of this invention are the ethylene oxide adducts and propylene oxide adducts of primary $C_8$ to $C_{22}$ alkanols sold commercially under the tradenames Berol by Akzo Nobel or Lutensol by BASF, and the ethoxylated and propoxylated types sold under the tradenames Plurafac by BASF.

The diluent which may be used is preferably potable water. However, also other compatible food grade diluents such as $C_2$ to $C_5$ alkanols, may also be used.

Additionally, the composition of the present invention may optionally include at least one anionic and/or nonionic surfactant. In some embodiments, a nonionic surfactant is suitably employed to improve surface wetting, soil removal, etc. It may also function to improve the solubility of the used fatty acids at use dilutions.

The composition of the present invention is, as already mentioned, capable of forming a use solution by admixing the composition with an diluent such as water. The obtained use solution generally comprises:

a) from about 1 to about 10 000 parts per million (ppm) of the defined hydroxyalkyl carboxylic acid, b) from about 1 to about 1 000 ppm of the defined $C_5$-$C_{18}$ alkyl monocarboxylic acid c) from about 1 to about 1 000 ppm of the defined dicarboxylic acid, d) an organic or inorganic acid as defined above in an amount sufficient to yield a use solution pH of about $\leqq 5.0$, preferably 4.5 to 1.0, e) from about 10 to about 10 000 ppm of a solubilizer as defined above, f) water as the balance of the composition and g) optionally at least one anionic or nonionic detergent to improve surface wetting, soil removal etc.

The antimicrobial sanitizing composition of the present invention may be successfully employed for sanitizing and/or disinfecting fixed-in-place food processing facilities such as those of dairy, brewery and beverage plants. The composition of the present invention exhibits an antimicrobial activity at a temperature of from about 0° C. to 80° C.

For carrying out sanitizing, the diluted use solution having a temperature of from 0 to 80° C., preferably from 5 to 60° C., is circulated through the system for a period of time sufficient to contact and kill undesirable microorganisms. This time can be anywhere from less than 30 seconds to about 10 or 20 minutes depending on the type and amount of contamination present. Preferably, the contact-time will be in the range of from about 1 to about 5 minutes. After sanitizing the composition is drained off from the system and the system is rinsed with potable water.

In most cleaning-in-place applications, the system can be brought back into service immediately after removal of the sanitizing solution. However, the system may also be rinsed with potable water or any other suitable material after sanitizing.

The sanitizing composition may be admixed with a detergent composition to impart the additional sanitizing properties of this invention to a detergent when in use. For example detergents are routinely used in European countries to clean various facilities in food, dairy, brewery and beverage plants in order to avoid the need for a subsequent sanitizing rinse of the facility. The sanitizing composition of the invention may also be used in other ways such as in track lubricants, teat dips and warewashing rinse aids. When the sanitizing composition is used in a detergent composition, appropriate surfactants are employed which preferably are those of the anionic or nonionic low foaming type. It is clear that such surfactant has to be compatible with the sanitizing composition so as to avoid degradation or separation in the final product.

For a more complete understanding of the present invention, reference is made to the following examples. The examples are only to be considered as illustrative and not limitative to the present invention. All percentages are "wt. %".

EXAMPLES

Preparation of the Compositions

Each of the following compositions was prepared by admixing the ingredients listed in the following table 1 in sequential order, blending thoroughly by agitation and allowing each ingredient to completely disperse or dissolve in the liquid mixture before addition of the next ingredient. The resultant compositions were clear and homogeneously uniform upon admixture of all listed ingredients. Compositions A1 to A4 contained the quaternary antimicrobial system of the present invention. Composition B1 is a comparative acidic composition corresponding to a prior art represented by presently commercially available compositions for standard CIP applications.

TABLE 1

| Composition | A1 | A2 | A3 | A4 | B1 |
|---|---|---|---|---|---|
| softened Water (%) | 38.0 | 41.0 | 35.0 | 35.0 | 15.0 |
| phospate ester (%) | 4.0 | 4.0 | | | 4.0 |
| cumene sulfonate (%) | 15.0 | 15.0 | 20.0 | 20.0 | 30.0 |
| 75%-$H_3PO_4$ (%) | — | — | 35.0 | — | 40.0 |
| 53%-$HNO_3$ (%) | 30.0 | 30.0 | — | 35.0 | — |
| 70%-glycolic acid (%) | 5.0 | 5.0 | 6.5 | 6.5 | — |
| octanoic acid (%) | 2.0 | 2.0 | 1.0 | 1.0 | 2.0 |
| N-octenyl succinic acid (%) | 6.0 | 3.0 | 2.5 | 2.5 | 9.0 |

Test Methods

1. Biocidal Efficacy Test

Quantitative suspension testing for the evaluation of bactericidal and fungicidal activity of chemical disinfectants and antiseptics used in food, industrial, domestic and institutional areas was conducted according to EN 1276:1997 (bacteria) and EN 1650:1997 (fungi), (CEN—European Committee for Standardization).

The tests were conducted with 0.25, 0.50, 1.00 and 4.00% use solutions prepared from the compositions of table 1 by diluting them with water in a sufficient amount to obtain each of the use solutions, e.g. by mixing 4 g of composition A1 with 96 g water for obtaining the 4 wt. % use solution A1. For dilution standardised sterile hard water with 300 mg/kg $CaCO_3$ was used. The samples were exposed at 20° C. to the challenge bacteria *Lactobacillus brevis*, the yeast *Saccharomyces diastaticus* and the mould *Aspergillus niger*. The resulting data are presented in table 2.

As can been seen from the data in table 2 the compositions A1 to A4 of the present invention containing the quaternary microbiocidal system show a significiant higher microbiocidal activity than the comparative composition B1, which corresponds to presently commercially available compositions for standard CIP in the industry. Even with half of the amount of octanoic acid (A3 and A4) or a third of the amount of N-octenyl succinic acid (A2, A3 and A4) the compositions A1 to A4 of the present invention provide the same or better microorganism reduction rates compared to comparative composition B1 under identical test conditions. Remarkable is in particular that compositions A1 to A4 provided a 99% reduction for *A. niger* with 4% use solutions, which is the economical upper limit for a use solution while the comparative composition B1 failed.

TABLE 2

| Composition | A1 | A2 | A3 | A4 | B1 |
|---|---|---|---|---|---|
| softened Water (%) | 38.0 | 41.0 | 35.0 | 35.0 | 15.0 |
| phosphate ester (%) | 4.0 | 4.0 | | | 4.0 |
| cumene sulfonate (%) | 15.0 | 15.0 | 20.0 | 20.0 | 30.0 |
| 75%-$H_3PO_4$ (%) | — | — | 35.0 | — | 40.0 |
| 53%-$HNO_3$ (%) | 30.0 | 30.0 | — | 35.0 | — |
| 70%-glycolic acid (%) | 5.0 | 5.0 | 6.5 | 6.5 | — |
| octanoic acid (%) | 2.0 | 2.0 | 1.0 | 1.0 | 2.0 |
| N-octenyl succinic acid (%) | 6.0 | 3.0 | 2.5 | 2.5 | 9.0 |
| Microbiology | minimal use concentration to pass the test | | | | |
| *A. niger* 20° C. 99% reduction 15 min contact time | passed (4%) | passed (4%) | passed (4%) | passed (4%) | failed (4%) |
| *S. diastaticus* 20° C. 99.99% reduction 15 min contact time | passed 0.25% | passed 0.5% | passed 1% | passed 1% | passed 1% |
| *L. brevis* 20° C. 99.999% reduction 5 min contact time | passed 0.25% | passed 0.5% | passed 0.5% | passed 0.5% | passed 0.5% |

2. Foaming Evaluation 2 litre of a 1% use solution was circulated with a flow rate of 1.8 l/s through a temperated 5.51 glass cylinder for 30 min to establish a foam/liquid equilibrium. The build-up of foam layer in cm was determined immediately at the end of a 30 min pumping period ("0") and 15 sec after switch off of the pump ("15").

TABLE 3

| Composition | A1 | A1 | A2 | A2 | A3 | A3 | A4 | A4 | B1 | B1 |
|---|---|---|---|---|---|---|---|---|---|---|
| time [sec] foam height [cm] | 0 | 15 | 0 | 15 | 0 | 15 | 0 | 15 | 0 | 15 |
| at 10° C. | 16 | 15 | 9 | 9 | <1 | 0 | <1 | 0 | 30 | 30 |
| at 20° C. | 10 | 10 | 6 | 5 | <1 | 0 | <1 | 0 | 20 | 20 |
| at 40° C. | 0 | 0 | 0 | 0 | 0 | 0 | 0 | 0 | 2 | 1 |
| at 60° C. | 0 | 0 | 0 | 0 | 0 | 0 | 0 | 0 | 1 | 1 |

The above data clearly show that the quaternary system of the invention leads to signifcant less or no foam, which is necessary for a CIP and/or SIP application compared to composition B1 representing the presently available commercially compositions for standard CIP and SIP applications.

3. Phase Separation (Stability) Test

Using the compositions of table 1 0.5%, 1%, 2% and 3% use solutions were prepared as explained above and after conditioning at 20° C. for 3 days they were visually inspected for physical instability.

"+" means stability (no phase separation);

"−" means instability (discernible phase separation).

| Composition Concentration | A1 | A2 | A3 | A4 | B1 |
|---|---|---|---|---|---|
| 0.5% | + | + | + | + | + |
| 1.0% | + | + | + | + | − |
| 2.0% | − | + | + | + | − |

Due to the possibility to reduce the amounts of microbiocidal agents (octanoic acid and N-octenyl succinic acid) the risk of phase separation according to the present invention is clearly lower. Therefore, higher concentrated use solutions for CIP and SIP applications are usable without any risk of residues being left behind in the treated plant.

The invention claimed is:

1. An acidic sanitizing and/or cleaning composition capable of being diluted to form an acidic sanitizing and/or cleaning use solution, the composition comprising:

a) a quaternary antimicrobial system comprising at least one $C_1$-$C_4$ hydroxyalkyl carboxylic acid or salt thereof, at least one $C_5$-$C_{18}$ alkyl monocarboxylic acid having the general formula:

R'''—COOH wherein R''' is a straight or branched, saturated or unsaturated alkyl moiety having from about 5 to about 18 carbon atoms, and said $C_5$-$C_{18}$ alkyl monocarboxylic is present in an amount of from about 0.1 to 5 wt. %, based on the total amount of the composition; or salt thereof, at least one dicarboxylic acid having the general formula:

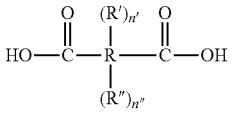

wherein R is a saturated or unsaturated hydrocarbon moiety having 2 carbon atoms; R' is hydrogen, hydroxyl, a substituted or unsubstituted n-alkyl or n-alkenyl moiety having from about 1 to about 12 carbon atoms, where suitable substituents of R' comprise thiol, methane thiol, amine, methoxy and aryl substituents and n' and n'' each are an integer of from 0 to 4; and R'' represents hydrogen or hydroxyl; or salt or anhydride thereof;

at least one acid capable of yielding a pH of about <5.0 upon dilution of the composition to a use solution, b) at least one solubilizer;

c) at least one diluent; and d) optionally at least one detergent.

2. An acidic sanitizing and/or cleaning composition capable of being diluted to form an acidic sanitizing and/or cleaning use solution, the composition comprising:

a) a quaternary antimicrobial system comprising at least one $C_1$-$C_4$hydroxyalkyl carboxylic acid or salt thereof, at least one $C_5$-$C_{18}$alkyl monocarboxylic acid having the general formula:

R'''—COOH wherein R''' is a straight or branched, saturated or unsaturated alkyl moiety having from about 5 to about 18 carbon atoms; or salt thereof, at least one dicarboxylic acid selected from the group consisting of maleic acid, fumaric acid, succinic acid, n-octyl succinic acid, n-octenyl succinic acid, n-nonyl succinic acid, n-nonenyl succinic acid, n-decyl succinic acid, n-decenyl succinic acid, n-hexyl succinic acid, n-hexenyl succinic acid, diisobutenyl succinic acid, methyl heptenyl succinic acid and mixtures thereof;

at least one acid capable of yielding a pH of about ≦5.0 upon dilution of the composition to a use solution, b) at least one solubilizer;

c) at least one diluent; and d) optionally at least one detergent.

3. The sanitizing and/or cleaning composition according to claim 2 wherein said at least one $C_1$-$C_4$-hydroxy alkyl carboxylic acid is an α-hydroxy alkyl carboxylic acid selected from the group consisting of glycolic acid, lactic acid, hydroxy propanoic acid, dihydroxy propanoic acid, hydroxy butyric acid, and mixtures thereof.

4. The sanitizing and/or cleaning composition according to claim 2, wherein said at least one $C_5$-$C_{18}$-alkyl monocarboxylic acid (β) is selected from the group consisting of pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid heptadecanoic acid, octadecanoic acid, neodecanoic acid, 2,2-dimethyloctanoic acid and mixtures thereof.

5. The sanitizing and/or cleaning composition according to claim 1, wherein said dicarboxylic acid is selected from the group consisting of maleic acid, fumaric acid, succinic acid, n-octyl succinic acid, n-octenyl succinic acid, n-nonyl succinic acid, n-nonenyl succinic acid, n-decyl succinic acid, n-decenyl succinic acid, n-hexyl succinic acid, n-hexenyl succinic acid, diisobutenyl succinic acid, methyl heptenyl succinic acid and mixtures thereof.

6. The sanitizing and/or cleaning composition according to claim 2, wherein said acid is an organic acid selected from the group consisting of formic acid, acetic acid, citric acid, and alkyl sulfonic acid or an inorganic acid selected from the group consisting of phosphoric acid, sulfuric acid, nitric acid, hydrochloric acid, sulfamic acid and mixtures thereof.

7. The sanitizing and/or cleaning composition according to claim 2, wherein said at least one solubilizer is a surfactant-hydrotrope selected from the group consisting of anionic surfactants, nonionic surfactants, zwitterionic surfactants and mixtures thereof.

8. The acid sanitizing and/or cleaning composition according to claim 7, wherein the anionic surfactant is selected from the group consisting of alkyl sulfonates and alkylaryl sulfonates having about 8 to about 22 carbon atoms in the alkyl portion, ammonium, alkali metal or alkaline earth metal salts or mixtures thereof.

9. The sanitizing and/or cleaning composition according to claim 7, wherein the zwitterionic surfactant is selected from the group consisting of alkylimidazolines, alkylamines and mixtures thereof.

10. The sanitizing and/or cleaning composition according to claim 7, wherein the nonionic surfactant is selected from the group consisting of ethylene oxide adducts of $C_8$to $C_{22}$, alcohols, ethylene oxide/propylene oxide adducts of ethylene glycol, alkylene glycols or mixtures thereof.

11. The sanitizing and/or cleaning composition according to claim 2, wherein said at least one diluent is selected from water and short chain alcohols having 2 to 5 carbon atoms.

12. The sanitizing and/or cleaning composition according to claim 2, wherein said dicarboxylic acid is present in an amount of from about 0.1 to 8 wt. %, based on the total amount of the composition.

13. The sanitizing and/or cleaning composition according to claim 2, wherein said acid is present in an amount of from about 4.0 to about 60.0 wt. %, based on the total amount of the composition.

14. The sanitizing and/or cleaning composition according to claim 2, wherein said diluent is present in an amount of from about 10 to about 95.5 wt. %, based on the total amount of the composition.

15. The sanitizing and/or cleaning composition according to claim 2, wherein said detergent is present in an amount of from about 5 to 30 wt. %, based on the total weight of the composition.

16. The sanitizing and/or cleaning composition according to claim 2, which composition is diluted with water in a ratio of from about 1:10 to about 1:500 parts of composition to water.

17. A low foaming acidic sanitizing and/or cleaning use solution comprising:

a) a quaternary antimicrobial system comprising at least one $C_1$-$C_4$ hydroxy alkyl carboxylic acid or salt thereof, at least one $C_5$-$C_{18}$ alkyl monocarboxylic acid having the general formula:

$$R'''—COOH$$

wherein R''' is a straight or branched, saturated or unsaturated alkyl moiety having from about 5 to about 18 carbon atoms; or salt thereof, at least one dicarboxylic acid having the general formula:

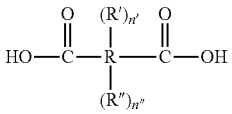

wherein R is a saturated or unsaturated hydrocarbon moiety having 2 carbon atoms; R' is hydrogen, hydroxyl, a substituted or unsubstituted n-alkyl or n-alkenyl moiety having from about 1 to about 12, where suitable substituents of R' comprise thiol, methane thiol, amine, methoxy and aryl substituents and n' and n" each are an integer of from 0 to 4; and R" represents hydrogen or hydroxyl; or salt or anhydride thereof;

at least one acid capable of yielding a pH of about ≦5.0 upon dilution of the composition to the use solution, b) at least one solubilizer;

c) at least one diluent; and d) optionally at least one detergent.

18. A low foaming acidic aqueous antimicrobial sanitizing and/or cleaning use solution wherein said composition according to claim 2 is diluted with sufficient water to provide: a) from about 1 to about 5000 ppm of the antimicrobial system; b) from about 5 to about 10000 ppm of the solubilizer, and c) a sufficient amount of the acid to yield a pH below about 5.0, d) optionally a sufficient amount of the detergent to induce surface wetting and soil removal and e) water as the balance of the composition.

19. A process for sanitizing and/or cleaning a hard surface, the process being carried out by contacting a low foaming acidic, aqueous, antimicrobial use solution according to any of claims 16 to 18 at a temperature of from 0 to 80° C. with the hard surface to be cleaned and/or sanitized for about 30 s to about 20 min draining off the use solution with or without recycling it, and finally rinsing the hard surface with potable water.

* * * * *